US007143810B1

(12) United States Patent
Johansen et al.

(10) Patent No.: US 7,143,810 B1
(45) Date of Patent: Dec. 5, 2006

(54) EQUIPMENT FOR CONTINUOUS HORIZONTAL CASTING OF METAL

(75) Inventors: Inge Johansen, Sunndalsøra (NO); Geir Mæland, Sunndalsøra (NO); Åge Strømsvåg, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 10/018,174

(22) PCT Filed: Jun. 26, 2000

(86) PCT No.: PCT/NO00/00221

§ 371 (c)(1),
(2), (4) Date: Mar. 12, 2002

(87) PCT Pub. No.: WO01/00352

PCT Pub. Date: Jan. 4, 2001

(30) Foreign Application Priority Data

Jun. 25, 1999 (NO) ..... 19993157

(51) Int. Cl.
*B22D 11/124* (2006.01)

(52) U.S. Cl. ..... 164/440; 164/444

(58) Field of Classification Search ..... 164/487, 164/440, 490, 444, 486, 268, 472
See application file for complete search history.

(56) References Cited

U.S. PATENT DOCUMENTS

| | | | | |
|---|---|---|---|---|
| 2,690,600 | A * | 10/1954 | Tarmann et al. | 164/268 |
| 3,556,197 | A * | 1/1971 | Foye | 164/268 |
| 4,363,352 | A * | 12/1982 | Pryor et al. | 164/418 |
| 4,501,317 | A * | 2/1985 | Sokolowski | 164/472 |
| 4,688,624 | A | 8/1987 | Suzuki et al. | |
| 5,205,344 | A * | 4/1993 | Nagai et al. | 164/440 |
| 5,228,496 | A * | 7/1993 | Nagai et al. | 164/472 |
| 5,325,910 | A * | 7/1994 | Schneider et al. | 164/472 |
| 5,678,623 | A * | 10/1997 | Steen et al. | 164/268 |
| 5,915,455 | A * | 6/1999 | Kittilsen et al. | 164/440 |
| 6,609,557 | B1 * | 8/2003 | Anderson | 164/459 |

FOREIGN PATENT DOCUMENTS

| | | |
|---|---|---|
| CH | 650 426 | 7/1985 |
| EP | 0 337 769 A2 * | 10/1989 |
| NO | 302804 | 4/1998 |

* cited by examiner

*Primary Examiner*—Kevin P. Kerns
(74) *Attorney, Agent, or Firm*—Wenderoth, Lind & Ponack, L.L.P.

(57) ABSTRACT

Equipment for continuous, horizontal casting of metal, in particular aluminum. The equipment includes an insulated reservoir or pool (2), which is designed to contain liquid metal, and a mold (3), which can be removed from the pool (2). An insulating plate (19) is provided with holes (25, 26) which communicate with the mold. The mold (3) includes a preferably circular cavity (17) defined by a wall (12, 13) of permeable material for the supply of oil and at least one annular slit or nozzle (16) arranged along the circumference of the cavity for the direct supply of coolant. In addition to the oil, gas can be supplied through the permeable material (12, 13) and annuli (20) are arranged between the permeable wall material and the mold housing (8) to distribute the gas/oil to the wall material. The annuli (20) is divided into sectors using plugs or similar restrictions (21) and are supplied with oil/gas via separate supply channels (10, 11) for each sector, thus making it possible to differentiate the supply of oil/gas around the circumference of the casting piece.

17 Claims, 3 Drawing Sheets

SECTION A-A

EQUIPMENT FOR CONTINUOUS HORIZONTAL CASTING OF METAL

BACKGROUND OF THE INVENTION

1. Field of the Invention

The present invention concerns equipment for continuous, horizontal casting of metal, in particular aluminum. The equipment includes an insulated reservoir or pool, which is designed to contain liquid metal, and a mold, which can be removed from the pool, with an insulating plate with holes that communicate with the mold. The mold includes a preferably circular cavity with wall material of permeable material, for example graphite, for the supply of oil and at least one tubular die arranged along the circumference of the cavity for the direct supply of coolant.

2. Description of Related Art

As stated above, directly cooled horizontal casting equipment for continuous casting of metal in which oil is supplied through the cavity wall through an annulus or a permeable wall element in order to form a lubricant film between the mold wall and the metal is already known.

Although this type of casting equipment functions reasonably well, the quality of the cast product is, however, much poorer than that of equivalent vertical casting equipment in which, in addition to oil, gas is also supplied through the cavity wall.

One of the disadvantages of vertical casting equipment is that it comprises a large number of molds. This makes it expensive to produce.

Moreover, the vertical equipment is only designed to cast specific lengths in a semi-continuous process. This also makes it expensive to operate.

Casting with horizontal casting equipment involves the use of only a few molds and the casting takes place continuously. Suitable lengths of the cast product are cut off during the casting operation. The continuous, horizontal casting equipment is thus both cheap to produce and cheap to operate.

SUMMARY OF THE INVENTION

One aim of the present invention was to produce horizontal equipment for continuous casting of metal, in particular aluminum, with which the quality of the cast product is as good as the quality of the equivalent cast product with vertical casting equipment.

The equipment in accordance with the present invention is characterized in that gas in addition to oil is supplied through the permeable wall material and that annuli are arranged between the permeable wall material and the mold housing to distribute the gas/oil to the wall material and that the annuli are divided into sectors using plugs and are supplied with oil/gas via separate supply channels for each sector, whereby the supply of oil/gas may be differentiated around the circumference of the mold cavity.

Figure 1:
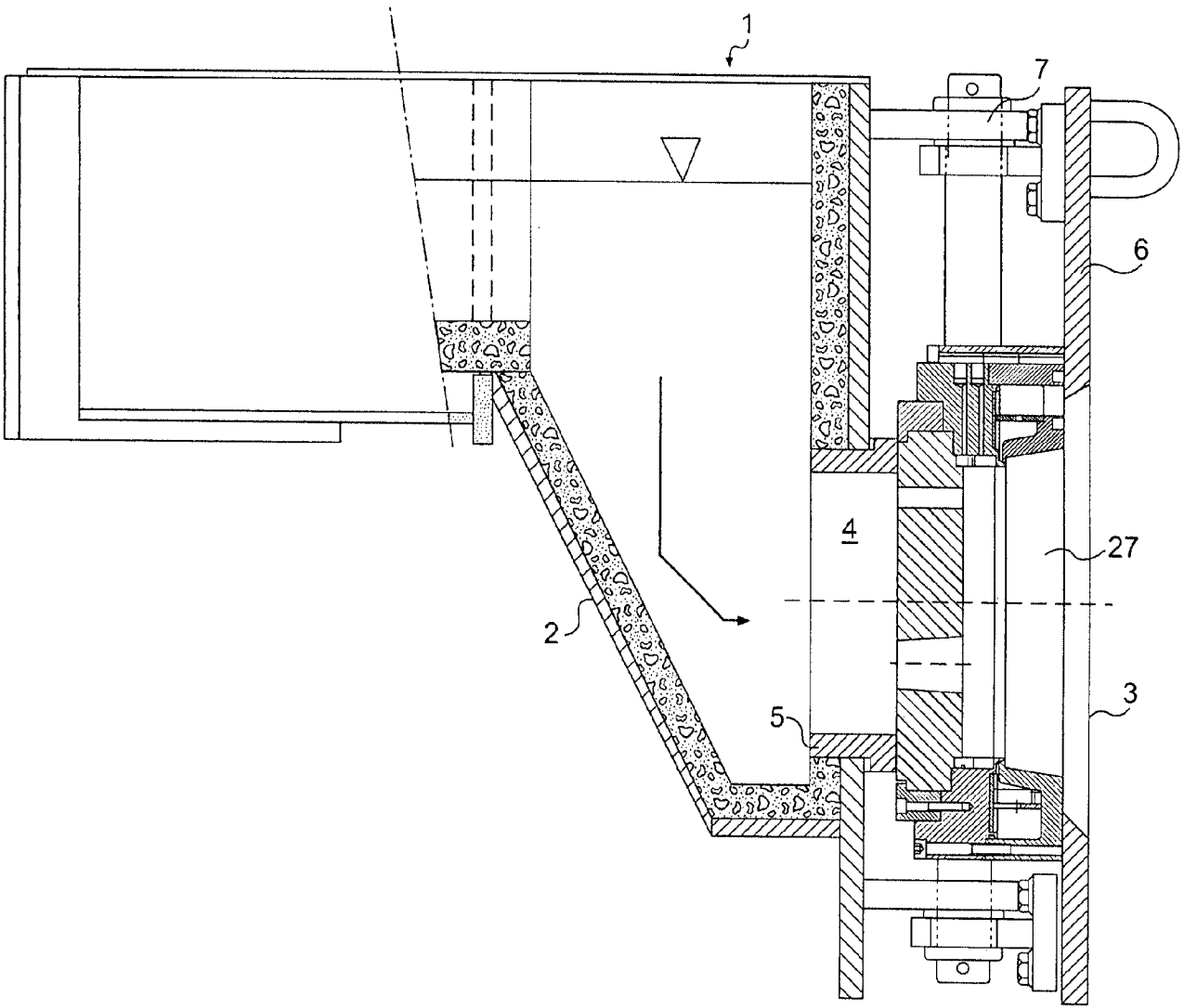
Figure 2A:
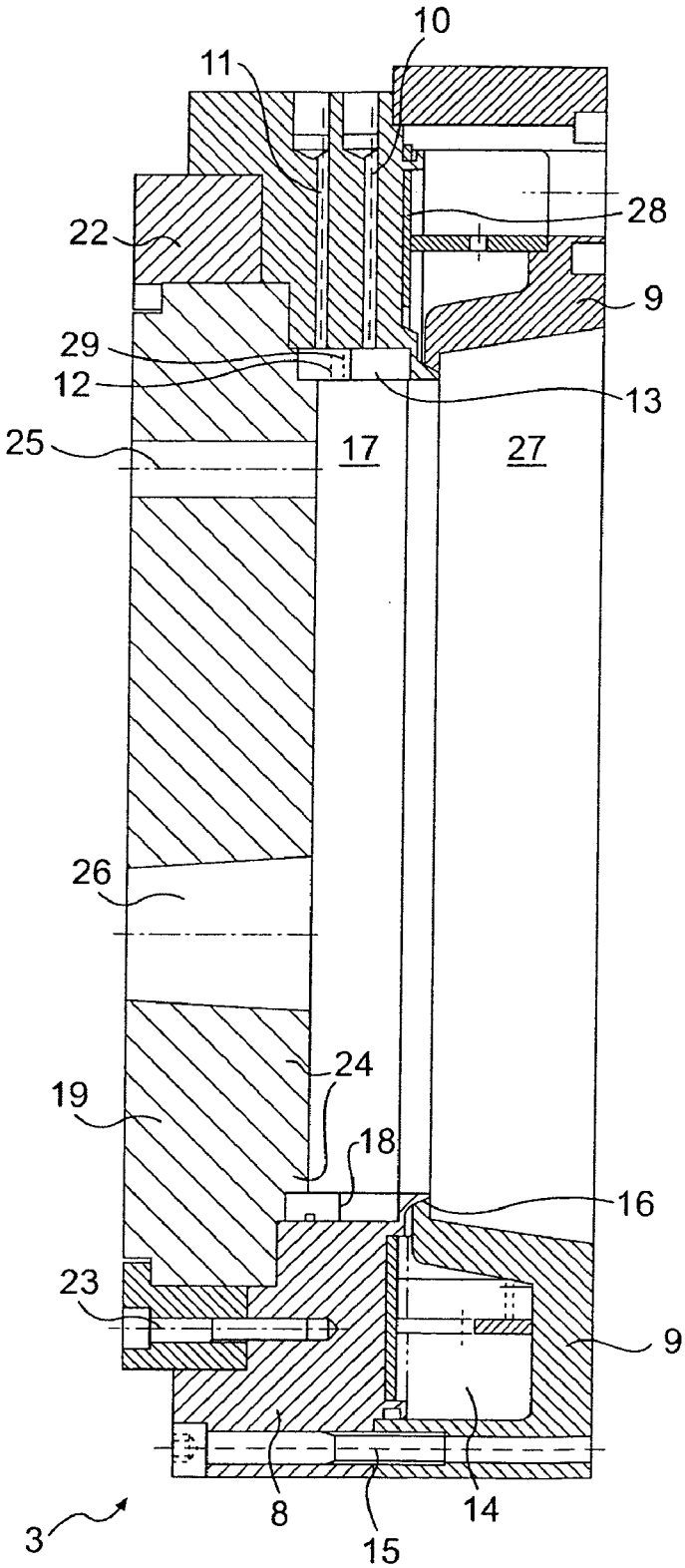
Figure 2B:
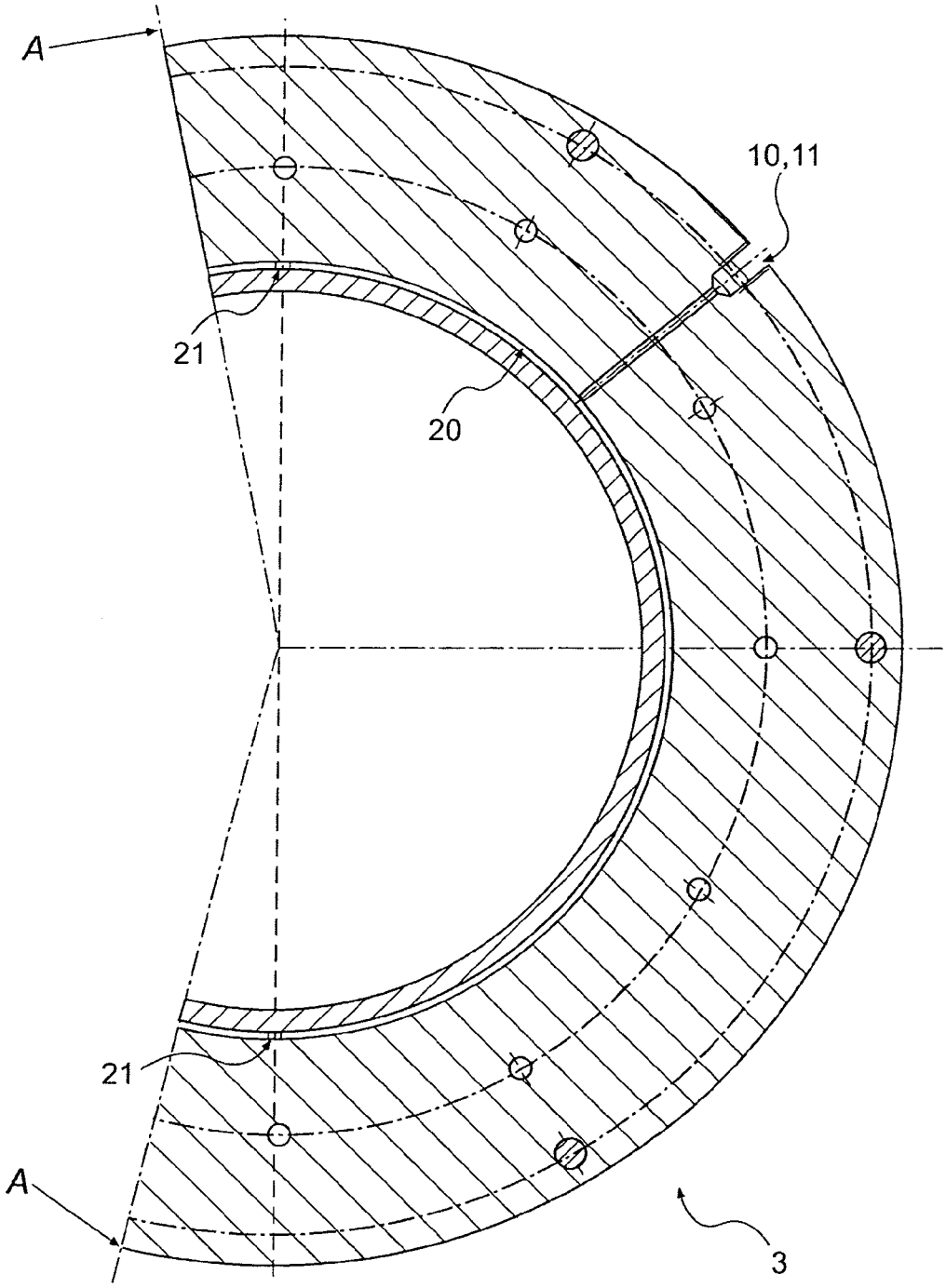

The present invention will be described in the following in further detail by way of examples and with reference to the attached drawings, in which:

FIG. 1 shows, in part, in an elevational view, casting equipment for continuous horizontal casting of long objects, for example aluminum billets; and FIG. 2*a* is an enlarged view of the mold shown in FIG. 1, taken in a longitudinal section along line A—A, and FIG. 2*b* is a cross sectional view of the mold shown in FIG. 1.

DETAILED DESCRIPTION OF THE INVENTION

As FIG. 1 shows casting equipment 1 constructed in accordance with the present invention. The casting equipment comprises an insulated metal reservoir or pool 2 and a mold 3. The pool 2 is provided with a lateral opening 4 to the mold 3, where a connecting ring 5 formed of thermally insulating material forms the transition between the pool and the mold 3. On its side, the mold is releasably attached to a holding device 6. Via a hinge link 7, it is possible to swing the holding device and thus the mold 3 from a position in which the holding device is in contact with the connecting ring 5 to a swung-out position which makes it possible to remove (replace) or repair the mold.

The mold itself, which is shown in further detail in FIGS. 2*a* and 2*b*, comprises a two-part annular housing, of which a first main housing part 8 is provided with drilled holes 10, 11 for the supply of oil or gas to interior, permeable cavity rings 12, 13, while a second housing part 9 is provided with an annular recess which forms a water cooling channel 14. The two housing parts 8 and 9 are held together by means of a number of screws 15. When the housing parts are screwed together, as shown in FIG. 2(*a*), a diagonal gap 16 is formed between the two parts so that, during the casting operation, water flows from the channel 14 and through the gap 16 along the entire periphery of the cast product just outside the outlet of the cavity 17.

As mentioned, permeable rings 12, 13, which are physically separated from each other by a gasket, sealing material 18 or the like, are included. These rings form the wall in the cavity 17.

An important feature of the present invention is that the annuli 20 (see FIG. 2*b* formed between the mold housing 8 and the rings 12, 13 are provided with plugs 21 (only two are shown in the drawing) so that the annuli 20 are broken up into two or more sectors as required. In this way, the supply of both gas and oil can be differentiated along the circumference of the cavity. Such differentiation, in particular of the gas supply, is important in order to be able to achieve a good casting result.

Supply of gas to the mold cavity of horizontal casting equipment is not previously known. To enable drainage of excess gas, and thereby avoid inclusion of gas in the cast metal product during the casting process, a bore 29 is provided through the mold wall (the ring 12). The gas is led to an annulus outside of the ring 12 and further through a bore in the housing 8 (not further shown) to the atmosphere or a suitable gas collecting tank or the like for the gas.

At the inlet of the cavity 17, there is a plate 19 formed of thermally insulating material ("hot-top") which is held in place by a retaining ring 22 via a screw connection 23.

As the wall of the cavity 17, the rings 12, 13 form the primary cooling area during the casting operation, the area of the wall surface will represent one of the factors which determine the cooling of the metal.

The insulating plate 19 may, depending on the type of alloy and the primary cooling required, extend somewhat along the ring 12 (at 24. Reference numeral 24 indicates a portion of the insulating plate that extends over a portion of the ring 12.

As the plate can be easily detached, it will be easy to replace the plate and thus cast different types of alloy in the same mold.

Otherwise, the casting equipment in accordance with the present invention works as will be described below.

Liquid metal, for example aluminum, is poured into the pool 2 from a casting furnace or the like (not shown). The metal flows through the opening 4 and the holes 25, 26 in the plate 19 and then into the cavity 17.

At the beginning of the casting operation, the outlet 27 in the mold 3 is closed using a mobile casting shoe (not shown). As soon as the metal has filled the cavity 17, the shoe begins to move, while water is supplied through the gap 16 and gas and oil are supplied through the ring 12, 13.

As the casting shoe moves and the cavity is refilled with metal via the pool, a long casting piece is formed. The shoe is removed as soon as the casting piece has reached a certain length. Since the casting process is continuous, the casting piece may actually be of any length. However, it is expedient for the casting piece to be cut (not shown) into suitable lengths for extrusion or other purposes.

As mentioned above, the casting equipment is designed to provide a differentiated supply of oil and gas around the circumference of the casting piece. In particular regarding the supply of gas, it has been found expedient to supply the same quantity of gas around the entire circumference of the cavity at the start of the casting process. Subsequently, when the casting process has started and has become stable, the gas supplied to the upper area of the cavity is reduced. Preferably, in this connection the annuli 20 for the supply of gas may be divided into two sectors, an upper sector and a lower sector, by means of restrictions (plugs) 21.

Moreover, regarding the primary cooling, i.e. the cooling provided through the rings 12, 13 in the cavity 17, it has been found expedient, in order to reduce the cooling, to make the mold housing 8 of steel instead of aluminum, which is the usual material. Furthermore, in order to reduce the cooling further, it may be necessary to shield (reduce the thermal transfer to) the cooling channel 14 by arranging an insulating annular plate 28, for example of PLEXIGLAS (polymethyl-methacrylate), on the side of the housing part which faces the cooling channel.

The present invention as defined in the claims, is not restricted to the embodiments shown in the drawings and described above, thus, instead of using two independent rings 12, 13 just one ring may be employed for the supply of oil and gas through the same ring.

The invention claimed is:

1. Horizontal continuous casting equipment for horizontal casting of metal, said equipment comprising an insulated reservoir for containing liquid metal, and a mold removably connected to said reservoir and defining an interior cavity, said mold comprising:

a mold housing;

permeable wall material provided along an interior wall of said mold housing, wherein thermal transfer through said permeable wall material provides primary cooling to the metal being cast;

at least one annular slit arranged along a circumference of the cavity for directly supplying coolant into the cavity, thereby providing secondary cooling to the metal being cast;

wherein oil and/or gas can be supplied through said permeable wall material, and annuli are formed between said permeable wall material and said mold housing to distribute the oil and/or gas to the permeable wall material, and wherein each of said annuli is divided into a plurality of sectors by restriction members, and each of the sectors is supplied with oil and/or gas via separate supply channels, thereby permitting differentiation of the oil and/or gas around the circumference of the mold.

2. The equipment as claimed in claim 1, wherein said permeable wall material comprises two rings which are separated by means of a gasket.

3. The equipment as claimed in claim 1, wherein said plurality of sectors comprises an upper sector and a lower sector.

4. The equipment as claimed in claim 1, wherein said supply channels comprise at least one gas supply channel and at least one oil supply channel, and said gas supply channel communicates with said respective sector at a location that is upstream relative to said oil supply channel.

5. The equipment as claimed in claim 1, wherein a gas evacuation passage is provided in an upper part of said mold in order to permit evacuation of excess gas from the mold cavity.

6. The equipment as claimed in claim 1, wherein said permeable wall material comprises two rings and a sealing structure interposed between said two rings.

7. The equipment as claimed in claim 1, wherein said mold housing is formed of steel.

8. The equipment as claimed in claim 1, wherein said mold housing comprises first and second parts, and said first part of said mold housing surrounds said permeable wall material, and a thermally insulating annular plate is disposed against said first part of said mold housing to reduce thermal transfer to the mold cavity.

9. The equipment as claimed in claim 1, wherein the gas and oil, which is supplied to said sectors and around the circumference of the mold cavity, lubricate the mold.

10. Horizontal continuous casting equipment for casting of aluminum, said equipment comprising an insulated reservoir for containing liquid metal, and a mold defining an interior cavity and being removably connected to said reservoir, said mold comprising:

a mold housing;

permeable wall material provided along an interior wall of said mold housing, wherein an outer circumferential surface of said permeable wall material defines an annular recess such that an annulus is formed by the interior wall of said mold housing and the outer circumferential surface of said permeable wall material;

a plurality of nozzles arranged along a circumference of the cavity for directly supplying coolant therethrough;

a plurality of plugs provided in said annulus so as to form a plurality of sectors; and a plurality of supply channels provided in said mold housing, wherein at least one separate supply channel communicates with each of said sectors so that gas and/or oil can be separately supplied to each of said sectors and supplied through said permeable material into the interior mold cavity so that the supply of oil and/or gas can be varied around the circumference of the mold cavity.

11. The equipment as claimed in claim 10, wherein said permeable wall material comprises two rings which are separated by means of a gasket.

12. The equipment as claimed in claim 10, wherein said plurality of sectors comprises an upper sector and a lower sector.

13. The equipment as claimed in claim 10, wherein a gas evacuation passage is provided in an upper part of said mold in order to permit evacuation of excess gas from the mold cavity.

14. The equipment as claimed in claim 10, wherein said permeable wall material comprises two rings and a sealing structure interposed between said two rings.

15. The equipment as claimed in claim 10, wherein said mold housing is formed of steel.

16. The equipment as claimed in claim 10, wherein said mold housing comprises first and second parts, and said first part of said mold housing surrounds said permeable wall material, and a thermally insulating annular plate is disposed against said first part of said mold housing to reduce thermal transfer to the mold cavity.

17. The equipment as claimed in claim 10, wherein the gas and oil, supplied to the interior mold cavity, are provided to lubricate the mold.

* * * * *